US008018158B2

(12) United States Patent
Kowalczyk et al.

(10) Patent No.: US 8,018,158 B2
(45) Date of Patent: Sep. 13, 2011

(54) METHOD AND APPARATUS FOR INTERACTION WITH A MODULATED OFF-AXIS ELECTRON BEAM

(75) Inventors: Richard Donald Kowalczyk, San Mateo, CA (US); Mark Frederick Kirshner, Redwood City, CA (US); Craig Bisset Wilsen, Redwood City, CA (US); Chad Daniel Marchewka, San Francisco, CA (US)

(73) Assignee: L-3 Communications Corporation, San Carlos, CA (US)

( * ) Notice: Subject to any disclaimer, the term of this patent is extended or adjusted under 35 U.S.C. 154(b) by 778 days.

(21) Appl. No.: 12/106,171

(22) Filed: Apr. 18, 2008

(65) Prior Publication Data

US 2008/0258625 A1 Oct. 23, 2008

Related U.S. Application Data

(60) Provisional application No. 60/913,202, filed on Apr. 20, 2007.

(51) Int. Cl.
*H01J 25/00* (2006.01)

(52) U.S. Cl. ..... 315/5; 315/501

(58) Field of Classification Search ..... 315/500, 315/501, 502, 5, 5.38, 5.39, 5.41, 5.42, 5.43
See application file for complete search history.

(56) References Cited

U.S. PATENT DOCUMENTS

| | | | | |
|---|---|---|---|---|
| 2,808,532 | A | | 10/1957 | Field |
| 2,854,603 | A | | 9/1958 | Collier |
| 3,249,792 | A | | 5/1966 | Pantell |
| 4,362,968 | A | | 12/1982 | Chu et al. |
| 4,571,524 | A | * | 2/1986 | Mourier ..... 315/4 |
| 5,389,854 | A | * | 2/1995 | True ..... 315/5.38 |
| 5,477,107 | A | * | 12/1995 | Tammaru et al. ..... 315/3.5 |
| 6,064,154 | A | | 5/2000 | Crouch et al. |
| 6,084,353 | A | * | 7/2000 | Bohlen ..... 315/5.32 |
| 2002/0149316 | A1 | | 10/2002 | Mako |
| 2006/0091830 | A1 | | 5/2006 | Theiss |

OTHER PUBLICATIONS

"A Chopper Driven 11.4-GHz Traveling-Wave RF Generator", G. Westenskow et al.; Lawrence Livermore National Laboratory; 1991 IEEE; pp. 646-648.

"Choppertron II", T.L. Houck et al.; Lawrence Livermore National Laboratory; 1996 IEEE; pp. 1524-1526.

* cited by examiner

*Primary Examiner* — David Hung Vu
(74) *Attorney, Agent, or Firm* — O'Melveny & Myers LLP

(57) ABSTRACT

An output circuit for a microwave tube is provided that has generally high interaction impedance for good efficiency, has high average power capability, and is physically large for a given operating frequency. The output circuit is designed to operate in conjunction with an off-axis, bunched electron beam. Electromagnetic fields are applied to the region in which the electron beam propagates to impart an azimuthal velocity to the bunched electron beam. The electron bunches then interact synchronously with a resonant output structure to excite radio-frequency modes from which energy can be extracted and applied to a load.

30 Claims, 10 Drawing Sheets

METHOD AND APPARATUS FOR INTERACTION WITH A MODULATED OFF-AXIS ELECTRON BEAM

RELATED APPLICATION DATA

This application claims the benefit, pursuant to 35 U.S.C. §119(e), of U.S. Provisional Application Ser. No. 60/913,202, filed Apr. 20, 2007.

BACKGROUND OF THE INVENTION

1. Field of the Invention

The present invention relates to electron tube microwave sources, and more particularly, to a method and apparatus for extracting microwave power from a modulated, off-axis electron beam.

2. Description of Related Art

Microwave vacuum tube amplifiers generally use either velocity or density modulation of an electron beam in order to establish an AC current that is subsequently converted to RF energy at an output of the amplifier device. Velocity modulation works by alternately accelerating and decelerating a beam of electrons passing through an RF-driven input structure, such as a cavity or traveling-wave circuit. As the electrons drift downstream, their velocity differences cause them to group at the RF frequency. In contrast, density modulation works by RF gating the electron flow directly from the cathode surface, accelerating the resulting electron bunches, and extracting power using an output section. As a consequence, density-modulated devices are generally considerably shorter than their velocity-modulated counterparts. Additionally, because electron emission is controlled by the RF drive level, density-modulated devices retain a high degree of efficiency even when operated in the linear region.

To convert the modulated electron beam into microwave radiation, the electron bunches are passed through an appropriate output circuit that generates an RF current in response to the electron beam. At very high frequencies, conventional linear-beam output circuits are necessarily very small. This is problematic because the small physical size complicates fabrication and limits power-handling capability of the device.

Accordingly, it is desirable to provide an output circuit for a microwave tube amplifier that is physically large for a given frequency, thereby allowing ease of manufacture. It is further desirable to provide an output circuit that has generally high interaction impedance for good efficiency, and that has high average power capability.

SUMMARY OF THE INVENTION

An apparatus for exciting radio-frequency oscillatory modes to extract energy from an electron beam includes an output structure adapted to interact with a bunched, off-axis electron beam. A bunched electron beam may be created by methods known in the art or by an apparatus such as that depicted in FIG. 1, which is an electron tube adapted to create an off-axis, density-modulated electron beam.

An embodiment of an output circuit in accordance with the present invention includes a cavity that is substantially cylindrical in shape. A magnetic field is applied along the axis of symmetry, and an electric field is applied in a perpendicular plane, extending from the walls of the cavity toward the central axis of symmetry. The magnetic field may be applied by any means well known in the art, such as by a solenoid coil wound around the outside of the cavity. The electric field may similarly be applied by methods known in the art such as by applying a voltage potential between a center conductor extending along the axis of the cylindrical cavity, and the outer cavity wall. The electric field may also be applied in an outward direction, extending from the central axis of symmetry toward the outer wall of the cavity.

The bunched electron beam propagates through the cavity with a component of its velocity directed along the axis of the cavity but also drifting around the axis under the influence of the crossed electric and magnetic fields. The bunched electron beam interacts with an output structure situated within the cavity to excite at least one radio-frequency resonant mode of the output structure. The electromagnetic power in the excited radio-frequency mode is then extracted by techniques well known in the art of magnetron and crossed-field amplifier design.

In another embodiment of an output structure in accordance with the present invention, a radial electric field is not required. Rather, the bunched electron beam rotates around the axis due to a cusp-type reversal created in the axial magnetic field. The technique of creating a cusp reversal in a magnetic field is well known in the art. The magnetic cusp may be produced using two solenoid coils wound in opposite senses. The first coil creates a magnetic field along the axis of the cavity, and the second creates a field along the axis pointing in the opposite direction. The opposing fields create a region of magnetic field reversal that induces azimuthal rotation in the passing electron beam.

In another embodiment of an output structure in accordance with the present invention, the output structure situated within the cavity is a slotted annular structure with vanes that extend radially into the cavity. The slotted configuration creates a slow-wave structure similar to that of magnetrons and crossed-field amplifiers. The electron bunches couple to the slow-wave structure to excite radio-frequency modes of the output structure.

In another embodiment, a fast-wave structure is developed in the output structure, which may be a smooth-walled annulus. The interaction of the electron bunches with the fast-wave structure excites resonant modes of the output structure.

In another embodiment in accordance with the present invention, the cavity includes an inner wall around the central axis of symmetry that may also serve as an inner conductor for creating a radial electric field. This inner wall may be either slotted or smooth and still fall within the scope and spirit of the present invention. When the radial electric field within the cavity is directed inward, toward the axis of symmetry, the electron bunches will couple efficiently to the outer wall. When the radial electric field is directed outward from the center of the cavity toward the outer wall, the electron bunches will couple efficiently to the inner wall. The outer and inner walls may be slotted or smooth, and the radial electric field may directed inward or outward and still fall within the scope and spirit of the present invention.

The synchronous interaction of the electron bunches with the output structure may also proceed via a cyclotron-wave interaction whereby the electron beam transfers energy to RF circuit modes with phase velocities that are comparable to the azimuthal velocity of the electron beam. It is also possible to couple to the electron bunches through a space-harmonic excitation that reduces the effective phase velocity, thus reducing the number of slots required to keep the electron and circuit phase velocities synchronous.

The method by which an output circuit operates in accordance with the present invention may also be used to improve the efficiency of a conventional magnetron by seeding a single desired operating frequency mode. Because conventional magnetrons may operate in a number of closely-spaced radio-frequency modes, they are generally not useful as stable and predictable frequency sources. However, by applying a bunched, off-axis electron beam to a conventional magnetron, a single resonant mode can be excited by the methods described above. The bunched electron beam seeds the desired frequency mode, enabling spectrally clean and efficient operation of the magnetron or similar crossed-beam amplifying device.

Thus, certain benefits of an output circuit for exciting radio-frequency modes of an output structure to extract energy from an electron beam have been achieved. Further advantages and applications of the invention will become clear to those skilled in the art by examination of the following detailed description of the preferred embodiment. Reference will be made to the attached sheets of drawing that will first be described briefly.

DETAILED DESCRIPTION OF THE PREFERRED EMBODIMENT

The invention provides an output circuit for a microwave tube that has generally high interaction impedance for good efficiency, that has high average power capability, and that is physically large for a given operating frequency. In the detailed description that follows, like element numerals are used to indicate like elements appearing in one or more of the figures.

Figure 1:
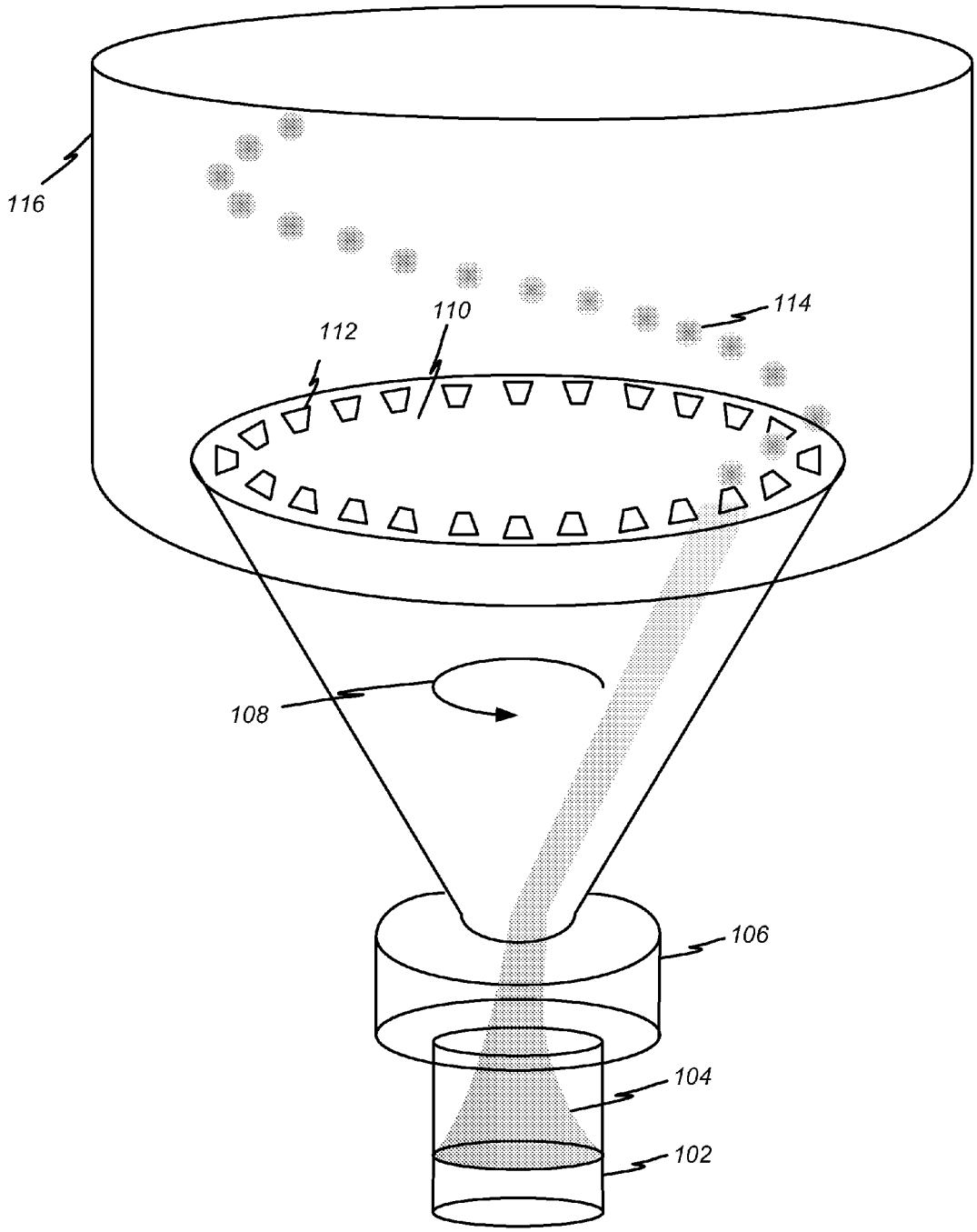
FIG. 1 depicts an exemplary electron tube providing an off-axis, density-modulated electron beam.

Referring to FIG. 1, an exemplary electron tube provides an off-axis, density-modulated electron beam. The electron beam 104 is emitted from an electron gun 102. As the beam passes through an input circuit 106, it is deflected by transverse electric fields, causing it to sweep out a cone-shaped region, indicated at 108, during one period of the drive frequency. The beam subsequently encounters a disk-shaped interceptor plate 110 that contains multiple slots 112 arranged adjacent to the periphery of the plate. As the beam 104 sweeps over the interceptor plate 110, the electrons alternate between passing through the slots and being collected on the plate, forming an off-axis bunched electron beam, e.g., 114, modulated at a frequency much greater than the drive frequency.

The electron tube of FIG. 1 is well suited for modulating an electron beam at frequencies that extend from the upper end of the microwave spectrum well into the terahertz range. To convert this modulated electron beam to electromagnetic radiation, an appropriate output circuit is required. As discussed above, conventional linear-beam output circuits are problematic because the small physical size complicates fabrication and limits power handling capability.

Figure 2A:
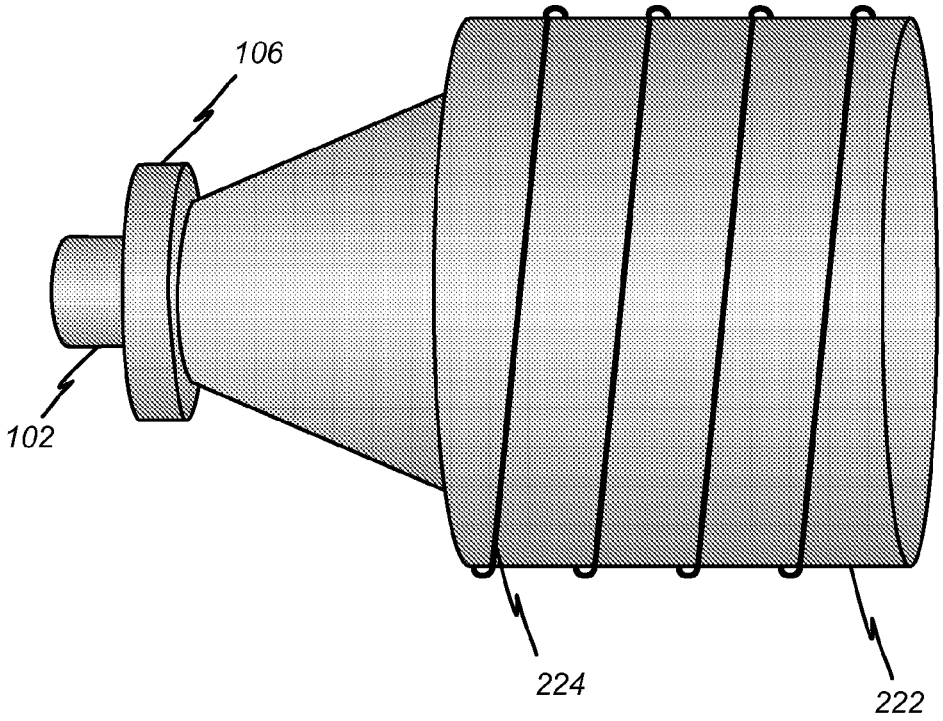
FIGS. 2A and 2B are a side perspective view and a cross-sectional view of an electron beam tube operating in accordance with an embodiment of the present invention.
Figure 2B:
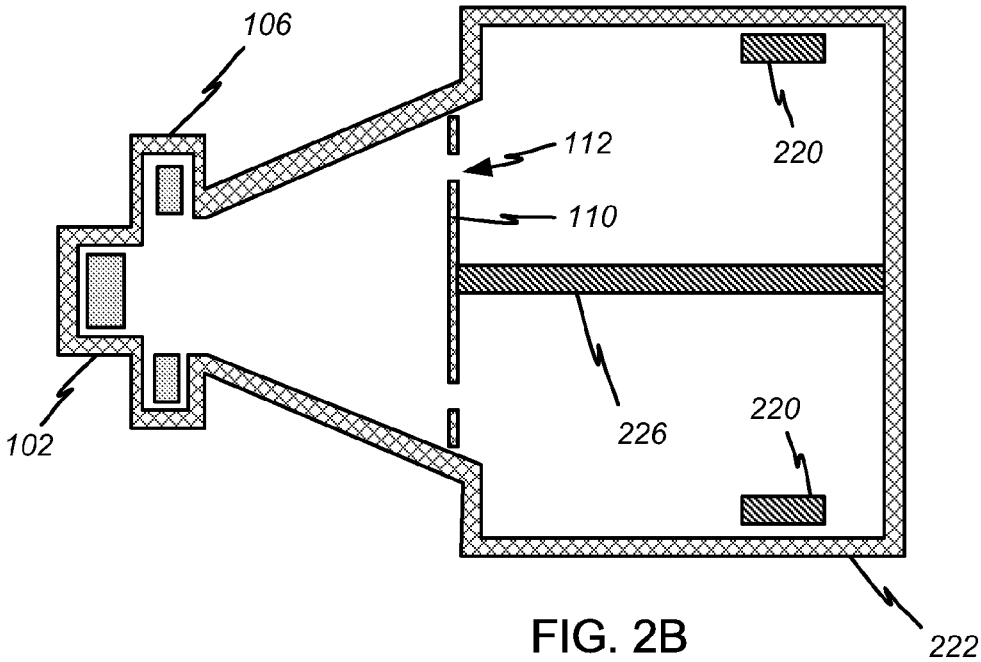

In an embodiment of the present invention, an output circuit enables extraction of the RF energy from the off-axis electron bunches, such as those produced by the electron tube of FIG. 1. FIGS. 2A and 2B depict a side perspective view and a cross-sectional view, respectively, of an electron tube that includes an embodiment of an output circuit in accordance with the present invention. An electron gun 102 generates an electron beam that is steered by an input circuit 106 to sweep out a conical path inside the electron tube, as depicted in FIG. 1. The sweeping electron beam encounters an interceptor plate 110 that contains slots 112 to allow passage of the beam. This section of the electron tube is responsible for producing a bunched, off-axis electron beam that then interacts with the output structure 220 contained within the cavity 222. It should be noted that other methods of creating a bunched, off-axis electron beam would also fall within the scope and spirit of the present invention. The apparatus and method of creating such a beam as shown in FIG. 1 is adopted here for purposes of illustration and does not constrain or limit the invention disclosed herein.

The bunched electron beam propagates through a cavity 222 that contains an annular output structure 220 in which radio-frequency oscillation modes are excited by the passing electron beam. An axial magnetic field is applied along the length of the cavity 222 by one of many methods known in the art. For example, a solenoid 224, wound around the outside of the cavity 222, could be employed to generate the axial magnetic field. A perpendicular electric field is also applied along a radius of the cavity. This field may be generated by applying a voltage to a center conductor 226 extending through the cavity to create a potential difference between the center of the cavity and the outer wall 222.

Figure 2C:
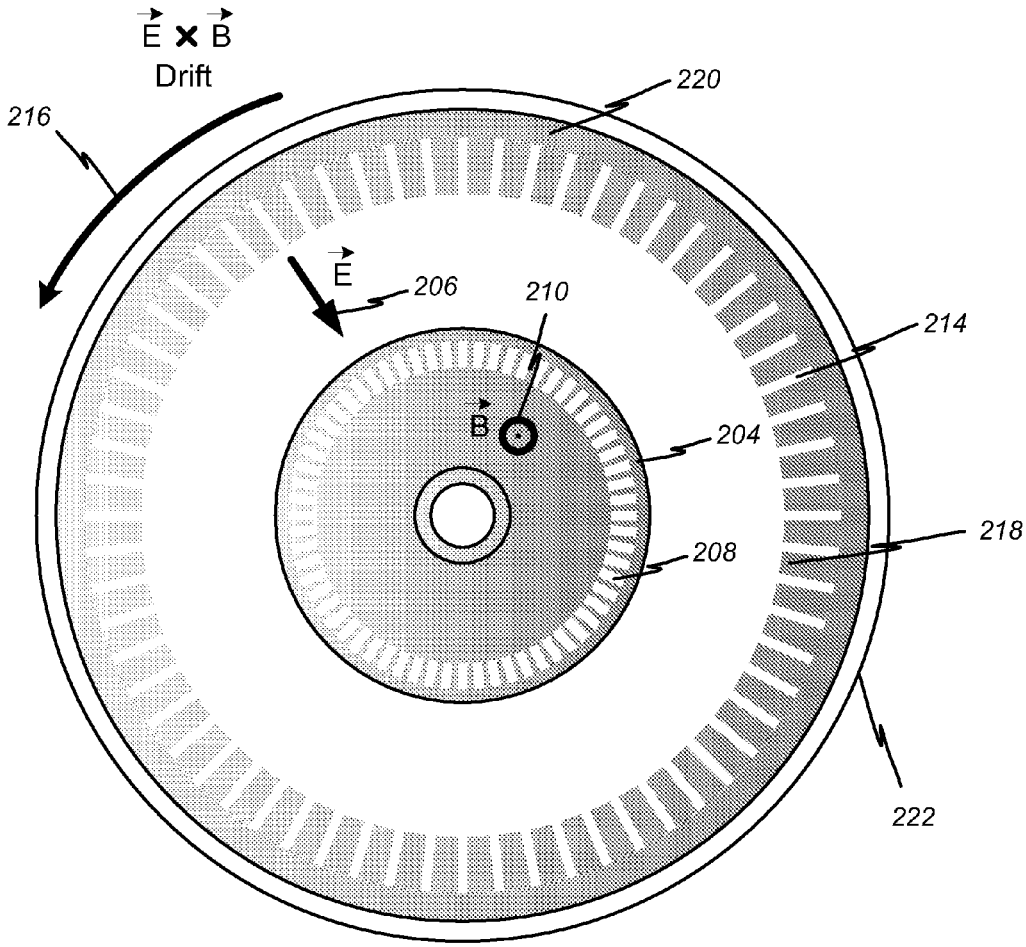
FIG. 2C is a top view of the exemplary output circuit depicted in FIGS. 2A-B, showing a slotted output structure.
Figure 3:
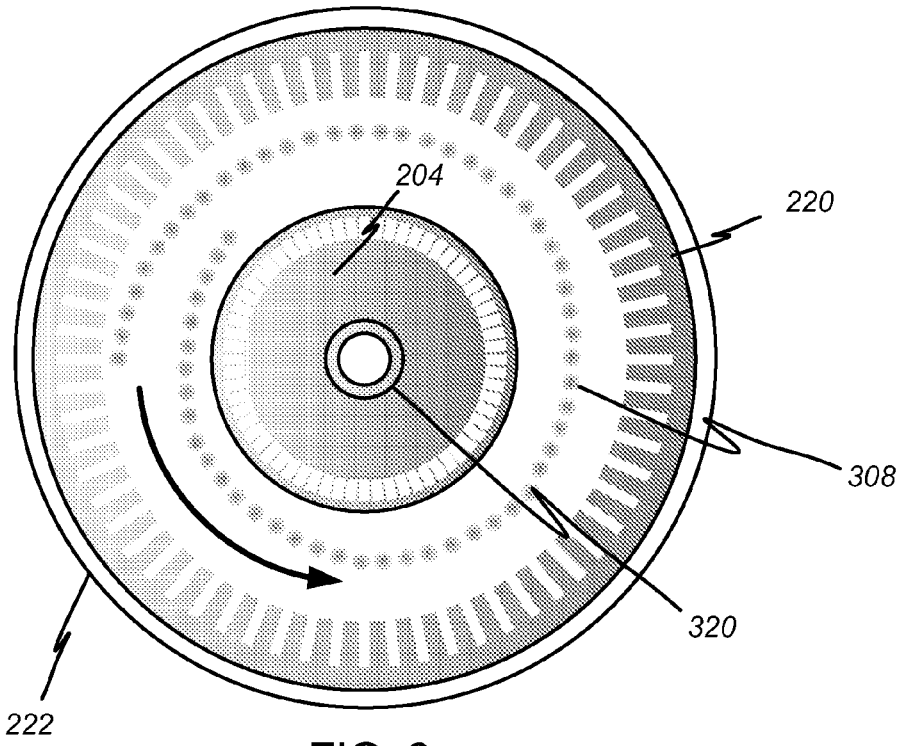
FIG. 3 is a top view of the exemplary output circuit depicted in FIGS. 2A-C, also illustrating the density-modulated electron beam interacting with the slotted-wall output structure.
Figure 4:
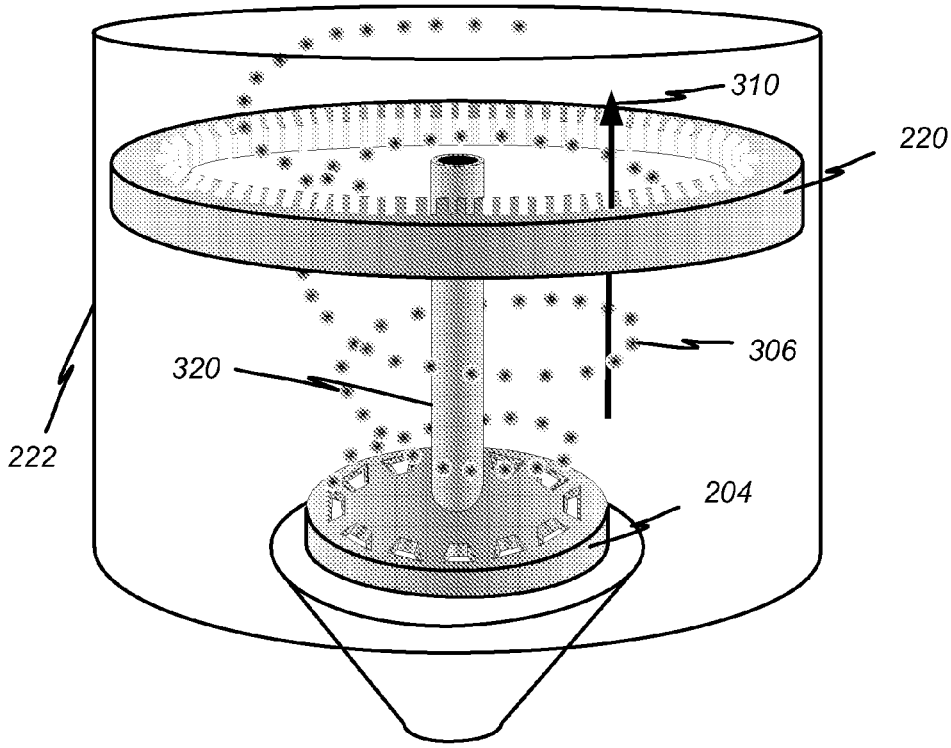
FIG. 4 is a side perspective view of the output circuit of FIGS. 2A-C, illustrating the interaction of the density-modulated electron beam with the output structure.

FIG. 2C depicts a top view of the embodiment shown in FIGS. 2A-B. The output structure 220 includes a slotted-wall slow-wave output structure, similar to the anode in magnetrons and crossed-field amplifiers, situated inside the outer wall 222 of the cavity. The slow-wave output structure 220 includes a plurality of slots, e.g., 214, separated by vanes, e.g., 218, that extend radially into the output cavity. The applied electric field 206 extends radially from the outer wall 220 of the cavity toward the center of the cavity. The orthogonal magnetic field 210 is applied parallel to the central axis of the cavity and extends out of the page as depicted in FIG. 2C. The interceptor plate 204, such as that used in the device depicted in FIG. 1, is used to create the bunched electron beam. FIGS. 3 and 4 depict a top view and a side perspective view, respectively, of the output structure 220 and interceptor plate 204 of FIGS. 2A-C and also illustrate the interaction of the bunched electron beam elements, e.g., 306 and 308, with the output structure 220. Upon entering the output circuit, the electron bunches, e.g., 306, are made to rotate about the central axis of the cavity by the crossed electric and magnetic fields as indicated at 216 in FIG. 2C. The bunches then interact with the slow-wave structure of the slotted output structure 220. More specifically, after the electron bunches emerge from the interceptor plate 204, they encounter a magnetic field 210, oriented along the central axis, and an electric field 206, oriented radially. The crossed fields cause the electron bunches to rotate azimuthally, with a radius much less than the cavity radius, due to cyclotron motion. Simultaneously, the $\vec{E}\times\vec{B}$ force causes the electrons to undergo an azimuthal guiding center drift, indicated at 216, about the symmetry axis of the device, with a radius comparable to the cavity radius. The bunches retain an axial velocity component 310, that causes them to traverse the output cavity, as shown in FIG. 4. During the transit, the bunches, e.g., 306, pass over the slotted structure 220 due to their azimuthal velocity. If the azimuthal velocity of the bunches is close to the phase velocity of an RF circuit mode, then the bunches excite the mode, transferring energy to the RF fields. The energy transferred to the RF fields can be coupled to the load through any suitable structure well known in magnetron and crossed-field amplifier design.

This invention has substantial advantages over a linear-beam output circuit. At a given frequency, the circuit can be much larger than a conventional resonant cavity used in an extended interaction klystron output or a traveling-wave output, thereby simplifying fabrication requirements. In addition, the distributed electron bunches have a lower power density, allowing for higher average output power operation.

Figure 5:
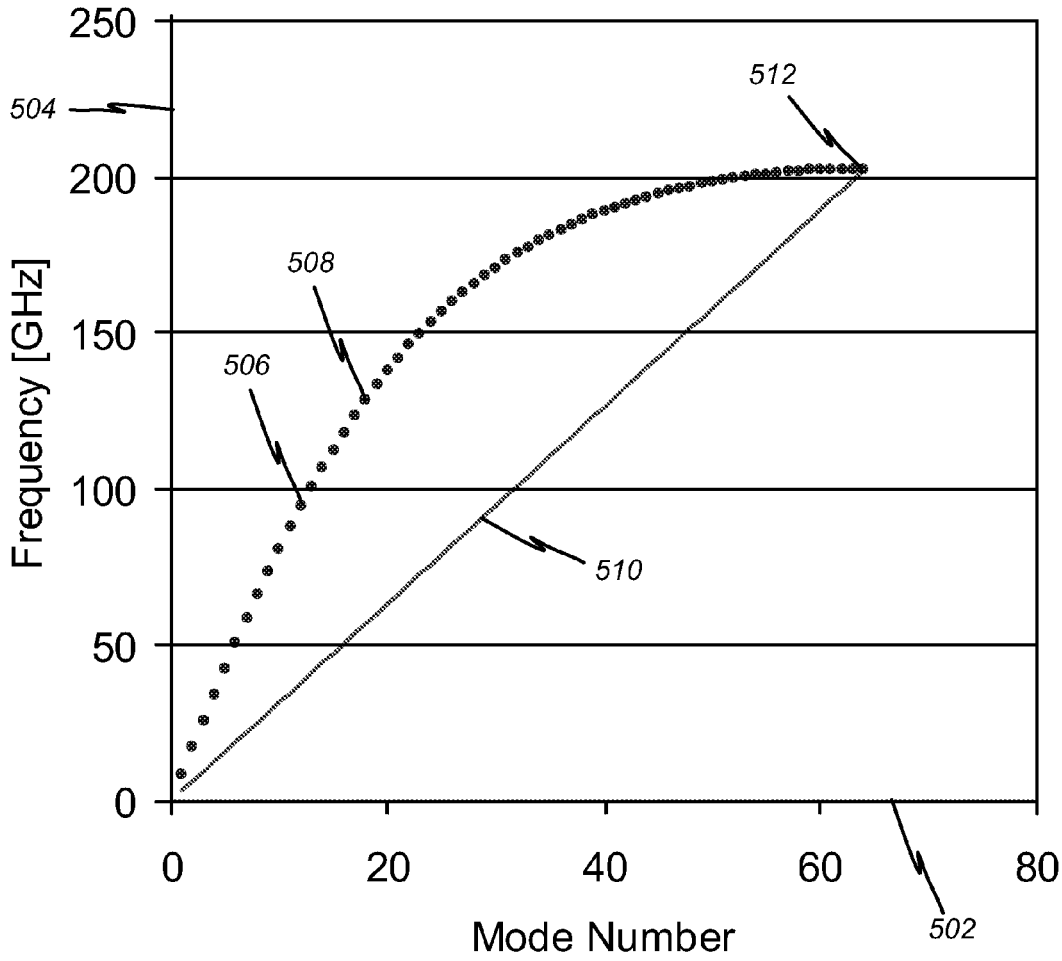
FIG. 5 is a chart illustrating a mode plot of the output circuit of FIGS. 2A-C in which each dot indicates an interaction mode, and the line indicates interaction with the highest frequency mode, i.e., the $\pi$ mode.

The output structure described here, used in conjunction with a method for providing electron bunches such as that depicted in FIG. 1, can be contrasted with a magnetron oscillator. Conventional magnetrons are not well suited for high-frequency operation. A slotted-wall circuit with N vanes contains N/2 modes capable of interacting with a rotating beam. The large number of vanes required for high-frequency operation produces many modes, with small frequency separation. FIG. 5 depicts the RF circuit modes of a 128-vane output circuit similar to that depicted in FIGS. 2A-C. The mode number is plotted along a horizontal axis 502, and the frequency of the mode is plotted along a vertical axis 504. Individual RF modes are indicated as dots, e.g., 506 and 508. The close frequency spacing of the modes can result in mode competition, compromising efficiency and stability in a conventional magnetron. In the device described herein in FIGS. 2-4, however, the circuit is driven by a bunched beam, with a profile and an azimuthal velocity that are chosen to force the circuit to operate in the selected mode. For example, the highest frequency mode, the $\pi$ mode at 208 GHz in this example, is illustrated in FIG. 5 by the line 510 extending to the highest frequency mode dot 512. The result is stable operation and a clean spectrum.

Various other embodiments of the invention are possible. If the electric field is directed radially inward, the electrons will interact optimally with a slotted-wall structure on the outer wall, similar to a conventional magnetron and consistent with the embodiment illustrated in FIGS. 2-4. Conversely, if the electric field is directed radially outward, the electrons will interact optimally with a slotted-wall structure on the inner wall (see element 320 of FIGS. 3 and 4), similar to an inverted magnetron. Non-standard configurations (i.e., a radially outward electric field and a slotted circuit on the outer wall or vice versa) may also be employed, as well as a circuit with slotted structures on both inner 320 and outer 302 walls, and an unslotted (i.e., smooth-wall) circuit.

Figure 6A:
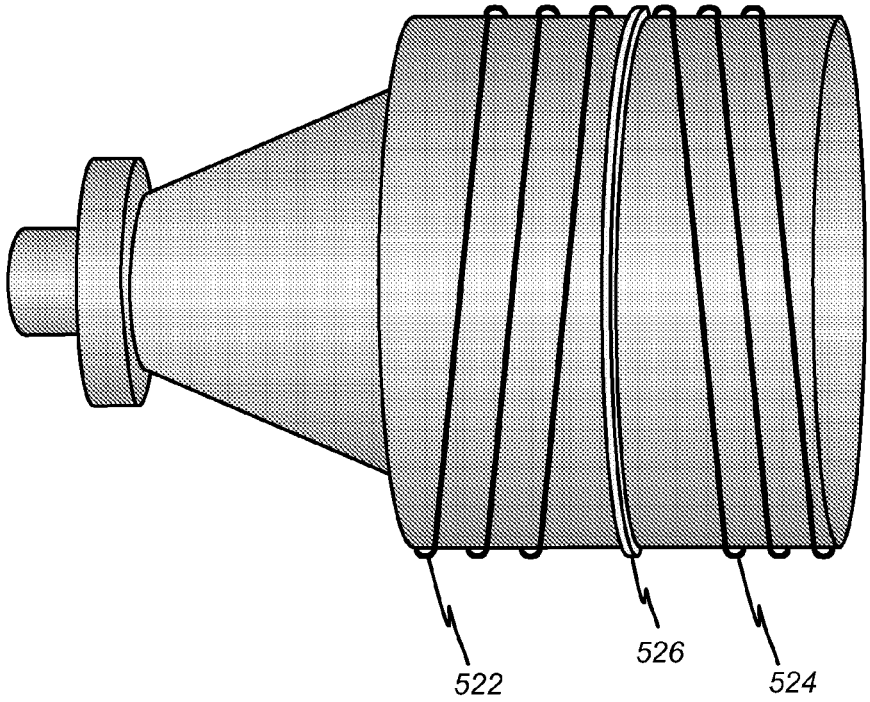
FIGS. 6A and 6B are a perspective view and a cross-sectional view of an alternative embodiment of an electron beam tube operating in accordance with the present invention.
Figure 6B:
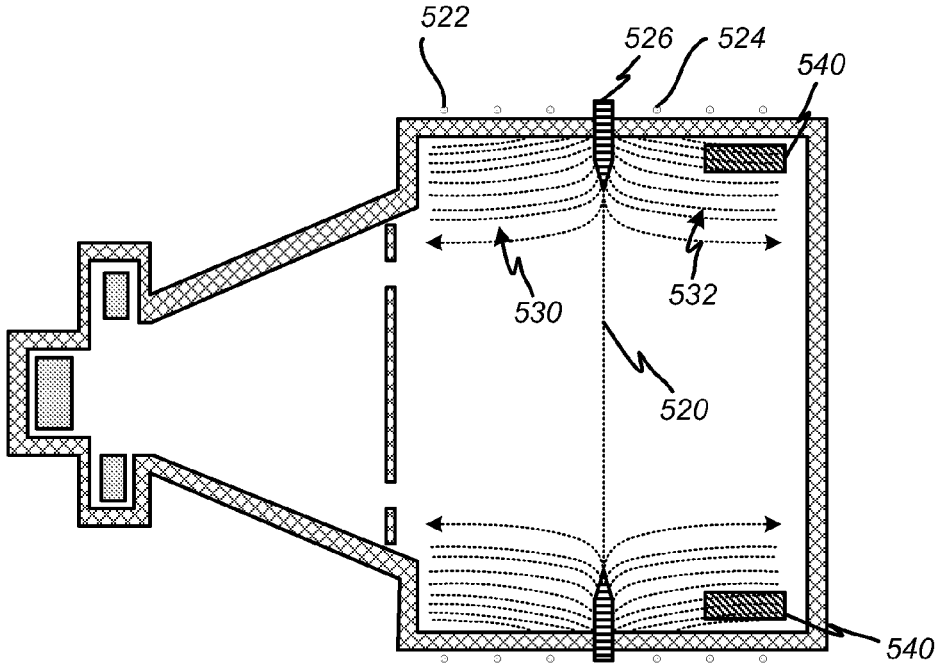

FIGS. 6A and 6B are a perspective view and a cross-sectional view, respectively, of an additional embodiment of an output circuit in accordance with the present invention in which the rotation of the off-axis bunched electron beam is achieved by creating a cusp-type magnetic field reversal within the cavity. Rather than using crossed electric and magnetic fields as in the embodiment of FIGS. 2A-C, two opposite magnetic fields 530 and 532 are employed to create a magnetic-field-reversal cusp 520 within the cavity in order to impart an azimuthal velocity to the electron beam. The technique of creating a cusp-like reversal of a magnetic field is well known in the art and may be achieved by using two solenoids 522 and 524 wound in opposite senses, along with an optional polepiece 526. The first solenoid 522 creates a magnetic field 530 along the axis of the cavity, and the second solenoid 524 creates a field 532 along the axis in the opposite direction. When the passing electron beam propagates through the field-reversal cusp 520, it is imparted with an azimuthal velocity. This rotational velocity then causes the electron bunches to couple to modes of the output structure 540 as the beam passes through it, as described previously.

The output circuit may also be driven by a space-harmonic excitation (forward or backward wave), reducing the phase velocity and thereby lowering the number of vanes required to keep the electron and circuit phase velocities synchronous. Lengthening the vanes and/or reducing the axial electron velocity will increase the time the electron bunches interact with the circuit, resulting in improved efficiency. Embellishments traditionally used to improve magnetron performance, such as vane strapping, hole and slot, rising-sun configurations and coaxial magnetron circuits may be used and would fall within the scope and spirit of the present invention.

Figure 7:
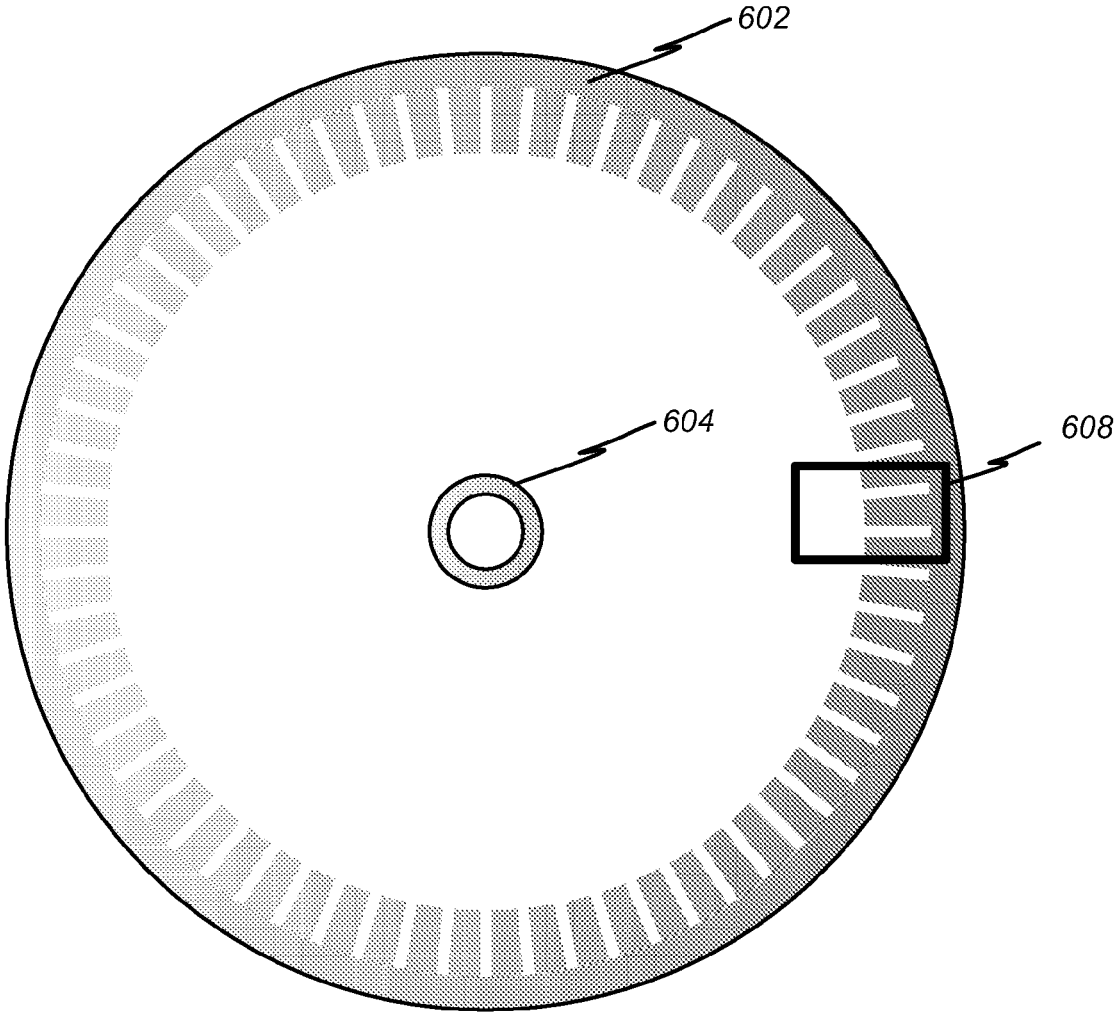
FIG. 7 is a top view of the slotted wall structure of an output circuit in accordance with the present invention.

FIG. 7 illustrates a top view of an embodiment of an output circuit in accordance with the present invention comprising a slotted outer wall 602 and a smooth inner wall 604. This embodiment has been developed and simulated using the Alliant Techsystems Inc. (ATK) electromagnetic particle-in-cell simulator MAGIC3D. The simulated design includes an output circuit operating at 208 GHz, with an applied voltage of 45 kV and an applied magnetic field of 0.25 tesla. To provide synchronous interaction with the $\pi$ mode of the slotted-wall circuit, 128 vanes are used. The region highlighted at 608 is shown in more detail in FIG. 8.

Figure 8:
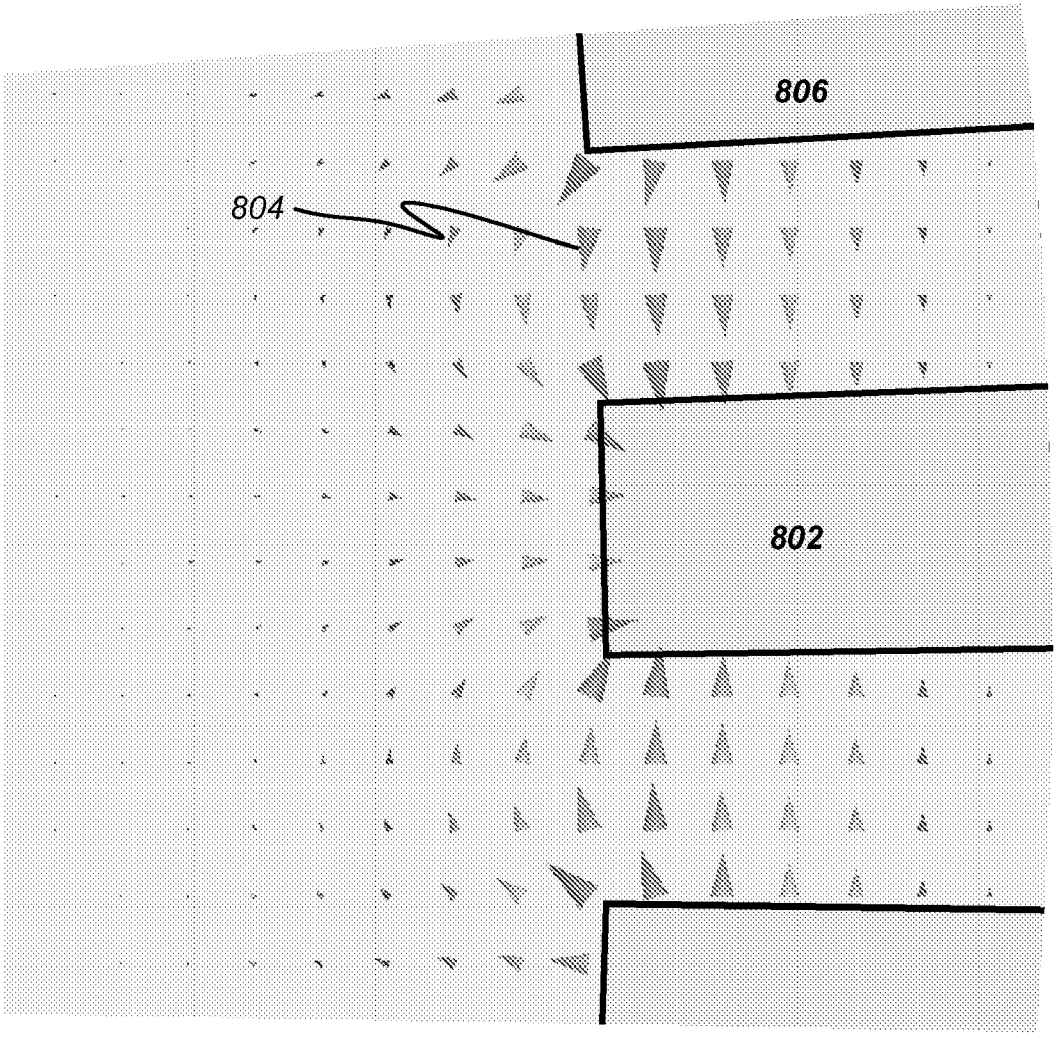
FIG. 8 is a magnified view of a portion of the output circuit of FIG. 7, illustrating the electric field vectors as modeled by the Ansoft HFSS simulation tool.

FIG. 8 depicts a detailed view of the electric field, e.g., 804, in the vicinity of vane 802 as modeled by the Ansoft HFSS electromagnetic simulation package for the output circuit of FIG. 7 operating in the $\pi$ mode.

Figure 9:
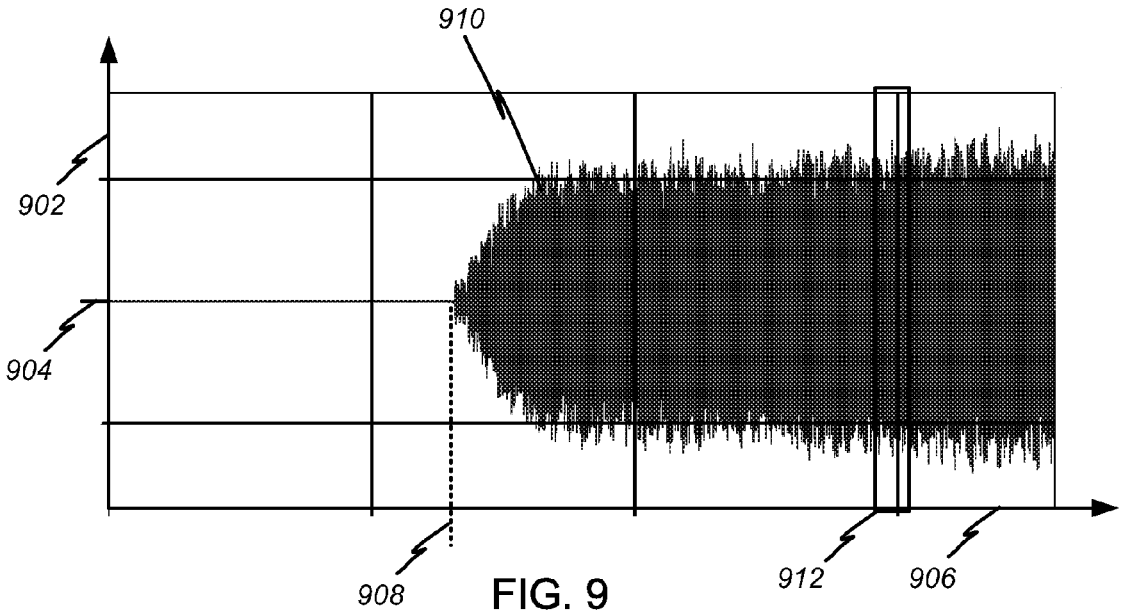
FIGS. 9 and 10 depict a graph showing gap voltage measured across a single cavity of the slotted-wall output structure of an output circuit in accordance with the present invention.
Figure 10:
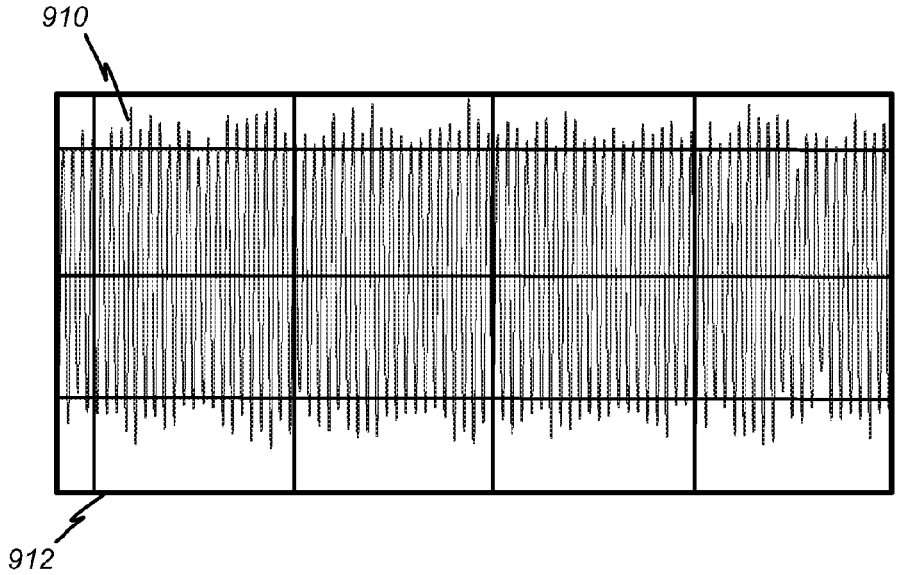

When the beam current is turned on, the gap voltage across a single cavity of the output structure (e.g., between vanes 802 and 806 of FIG. 8), begins to increase. FIGS. 9 and 10 illustrate the gap voltage as a function of time as the beam is turned on. The gap voltage 910 is plotted along a vertical axis 902 centered on zero 904. Time is plotted along a horizontal axis 906, increasing to the right. When the beam current is turned on at 908, the amplitude of the gap voltage 910 begins to increase. A portion of the gap voltage plot indicated at 912 is shown in expanded detail in FIG. 10. As is evident from the voltage trace 910 of FIG. 10, the interaction of the bunched off-axis electron beam with the output structure induces an oscillating RF voltage between the vanes of the output circuit.

Figure 11:
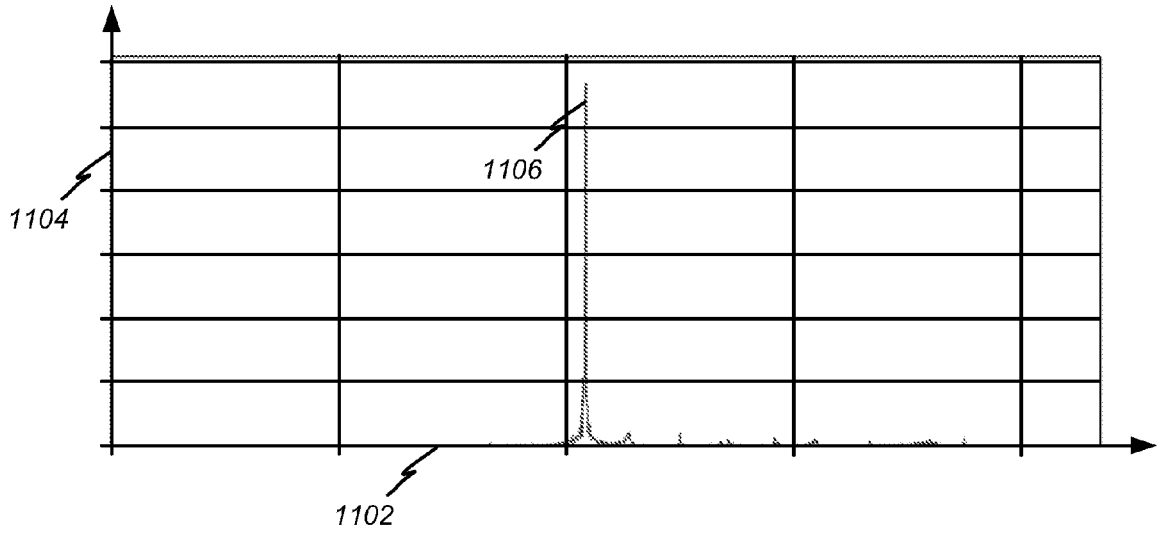
FIG. 11 is a graph showing the frequency spectrum of the gap voltage depicted in FIGS. 9 and 10.

FIG. 11 depicts the frequency spectrum of this induced oscillating RF voltage. Frequency is plotted along a horizontal axis 1102, and the amplitude of the frequency component in volts per frequency bin is plotted along a vertical axis 1104. The peak 1106 of the spectrum indicates that the dominant frequency component of the gap voltage is a single mode, at 208 GHz, corresponding to the $\pi$ mode of the circuit. The largest competing mode is 29 dB lower in amplitude, illustrating the clean spectrum that the invention is able to achieve. The power extracted from the beam is 38 watts.

The invention may also be used in a different application to improve the performance of a conventional magnetron. The operating field pattern of a magnetron can be seeded by injecting a single off-axis bunched beam as described previously, thereby reducing mode competition and improving efficiency.

An additional embodiment of an output circuit in accordance with the present invention uses a fast-wave interaction circuit that may be slotted or unslotted to interact with a pre-bunched electron beam.

Another embodiment of the invention uses an off-axis beam to excite a synchronous or cyclotron wave on a transverse-wave amplifier circuit. The off-axis beam may or may not be modulated.

In conclusion, the invention provides a novel output circuit suitable for use with a modulated, off-axis electron beam. Initial unoptimized simulations demonstrate the extraction of tens of watts at over 200 GHz. Based on these results, it is predicted that hundreds of watts at frequencies extending well into the terahertz range will ultimately be achievable. Combined with its potential for compact packaging, this invention is well suited to mobile applications, including high-resolution remote sensing and secure communications. Those skilled in the art will likely recognize further advantages of the present invention, and it should be appreciated that various modifications, adaptations, and alternative embodiments thereof may be made within the scope and spirit of the present invention. The invention is further defined by the following claims.

What is claimed is:

1. An output circuit for an electron beam device comprising:

a cavity substantially cylindrical in shape comprising at least an outer wall and a central axis of symmetry;

an electron gun adapted to produce an electron beam propagating through the cavity wherein:

the electron beam propagates through the cavity along a path that is offset from the central axis of symmetry;

the electron beam propagates with a velocity that has a component along a direction parallel to the central axis of symmetry; and the electron beam is spatially bunched into a plurality of electron bunches;

a substantially annular output structure situated within the cavity and centered on the central axis of symmetry; and at least one electromagnetic generating structure adapted to induce electromagnetic fields within the cavity to impart an azimuthal velocity to the electron beam;

wherein the output structure is adapted to interact synchronously with the plurality of electron bunches to cause at least one radio-frequency mode of the output structure to be excited.

2. The output circuit of claim 1, wherein the at least one electromagnetic generating structure comprises:

a magnetic generating structure adapted to produce a magnetic field extending in a direction parallel to the central axis of symmetry; and an inner conducting structure situated along the central axis of symmetry and adapted to maintain a voltage potential difference with respect to the outer wall of the cavity to generate an electric field extending in a direction perpendicular to the central axis of symmetry and along a radius of the cavity.

3. The output circuit of claim 2, wherein the electric field is directed in a direction extending from the outer wall toward the central axis of symmetry of the cavity.

4. The output circuit of claim 2, wherein the electric field is directed in a direction extending from the central axis of symmetry toward the outer wall of the cavity.

5. The output circuit of claim 1, wherein the at least one electromagnetic generating structure comprises:

a first magnetic generating structure adapted to produce a first magnetic field extending in a direction parallel to the central axis of symmetry; and a second magnetic generating structure adapted to produce a second magnetic field extending in a direction parallel to the central axis of symmetry and opposite to the first magnetic field.

6. The output circuit of claim 5, wherein the at least one electromagnetic generating structure further comprises a polepiece situated between the first magnetic generating structure and the second magnetic generating structure.

7. The output circuit of claim 1 wherein the output structure is adapted to include a plurality of slots for developing a slow-wave structure.

8. The output circuit of claim 1, wherein the cavity is further adapted to include an inner wall in proximity to the central axis of symmetry.

9. The output circuit of claim 8 wherein the inner wall is further adapted to include a plurality of slots for developing a slow-wave structure.

10. The output circuit of claim 1, wherein the output structure is further adapted to interact with the plurality of electron bunches via a fast-wave interaction.

11. The output circuit of claim 1, wherein the output structure is further adapted to interact with the plurality of electron bunches via a cyclotron wave interaction.

12. The output circuit of claim 1, wherein the output structure is further adapted to interact with the plurality of electron bunches through a space-harmonic excitation.

13. An output circuit for an electron beam device comprising:

a cavity substantially cylindrical in shape comprising at least an outer wall and a central axis of symmetry;

an electron gun adapted to produce an electron beam propagating through the cavity wherein:

the electron beam propagates through the cavity along a path that is offset from the central axis of symmetry;

the electron beam propagates with a velocity that has a component along a direction parallel to the central axis of symmetry; and the electron beam is spatially bunched into a plurality of electron bunches;

a substantially annular output structure situated within the cavity and centered on the central axis of symmetry, wherein the output structure is adapted to include a plurality of slots for developing a slow-wave structure; and at least one electromagnetic generating structure adapted to induce electromagnetic fields within the cavity to impart an azimuthal velocity to the electron beam;

wherein the output structure is adapted to interact synchronously with the plurality of electron bunches via the slow-wave structure developed in the output structure to cause at least one radio-frequency mode of the output structure to be excited.

14. The output circuit of claim 13, wherein the at least one electromagnetic generating structure comprises:

a solenoid adapted to produce a magnetic field extending in a direction parallel to the central axis of symmetry; and an inner conducting structure situated along the central axis of symmetry and adapted to maintain a voltage potential difference with respect to the outer wall of the cavity to generate an electric field extending in a direction perpendicular to the central axis of symmetry and along a radius of the cavity.

15. The output circuit of claim 13, wherein the at least one electromagnetic generating structure comprises:

a first solenoid adapted to produce a first magnetic field extending in a direction parallel to the central axis of symmetry;

a second solenoid adapted to produce a second magnetic field extending in a direction parallel to the central axis of symmetry and opposite to the first magnetic field; and a polepiece situated between the first solenoid and the solenoid.

16. The output circuit of claim 13, wherein the cavity is further adapted to include an inner wall in proximity to the central axis of symmetry.

17. The output circuit of claim 16 wherein the inner wall is further adapted to include a plurality of slots for developing a slow-wave structure.

18. The output circuit of claim 13, wherein the output structure is further adapted to interact with the plurality of electron bunches through a space-harmonic excitation.

19. In a system comprising an electron gun adapted to generate an electron beam, a substantially cylindrical cavity comprising a central axis of symmetry, and a substantially annular output structure, a method of exciting a radio-frequency mode in the output structure comprises:

propagating the electron beam through the cavity along a path that is offset from the central axis of symmetry;

spatially bunching the electron beam into a plurality of electron bunches;

applying a magnetic field along a direction parallel to the central axis of symmetry of the cavity;

applying an electric field along a direction perpendicular to the central axis of symmetry of the cavity and along a radius of the cavity;

imparting an azimuthal drift velocity to the plurality of electron bunches under the influence of the perpendicular electric and magnetic fields; and exciting at least one radio-frequency mode of the output structure as the plurality of electron bunches interact synchronously with the output structure.

20. The method of claim 19, wherein the step of applying an electric field further comprises directing the electric field in a direction toward the central axis of symmetry of the cavity.

21. The method of claim 19, wherein the step of applying an electric field further comprises directing the electric field in a direction away from the central axis of symmetry of the cavity.

22. The method of claim 19, wherein the step of exciting at least one radio-frequency mode of the output structure further comprises the steps of:

developing a slow-wave structure in the output structure; and coupling the plurality of electron bunches to the slow-wave structure.

23. The method of claim 19, wherein the step of exciting at least one radio-frequency mode of the output structure further comprises the steps of:

developing a fast-wave structure in the output structure; and coupling the plurality of electron bunches to the fast-wave structure.

24. The method of claim 19, wherein the step of exciting at least one radio-frequency mode of the output structure further comprises coupling the plurality of electron bunches to a cyclotron wave within the output structure.

25. The method of claim 19, wherein the step of exciting at least one radio-frequency mode of the output structure further comprises coupling the plurality of electron bunches to a space-harmonic radio-frequency mode within the output structure.

26. In a system comprising an electron gun adapted to generate an electron beam, a substantially cylindrical cavity comprising a central axis of symmetry, and a substantially annular output structure, a method for exciting a radio-frequency mode in the output structure comprises:

propagating the electron beam through the cavity along a path that is offset from the central axis of symmetry;

spatially bunching the electron beam into a plurality of electron bunches;

applying a first magnetic field along a direction parallel to the central axis of symmetry of the cavity;

applying second magnetic field along a direction opposite to the first magnetic field;

imparting an azimuthal velocity to the plurality of electron bunches under the influence of the first magnetic field and second magnetic field; and exciting at least one radio-frequency mode of the output structure as the plurality of electron bunches interact synchronously with the output structure.

27. The method of claim 26, wherein the step of exciting at least one radio-frequency mode of the output structure further comprises the steps of:

developing a slow-wave structure in the output structure; and coupling the plurality of electron bunches to the slow-wave structure.

28. The method of claim 26, wherein the step of exciting at least one radio-frequency mode of the output structure further comprises the steps of:

developing a fast-wave structure in the output structure; and coupling the plurality of electron bunches to the fast-wave structure.

29. The method of claim 26, wherein the step of exciting at least one radio-frequency mode of the output structure further comprises coupling the plurality of electron bunches to a cyclotron wave within the output structure.

30. The method of claim 26, wherein the step of exciting at least one radio-frequency mode of the output structure further comprises coupling the plurality of electron bunches to a space-harmonic radio-frequency mode within the output structure.

* * * * *